US005856655A

United States Patent [19]

Lin

[11] Patent Number: 5,856,655

[45] Date of Patent: Jan. 5, 1999

[54] POWER CONTROL DEVICE FOR A PRESSING IRON USING A POSITION SENSOR THAT INCLUDES AN OPTICAL COUPLER AND A SHIELDING PLATE

[76] Inventor: Jenny Lin, No. 227, Nan-Yang Rd., Feng-Yuan City, Taichung Hsien, Taiwan

[21] Appl. No.: 62,229

[22] Filed: Apr. 16, 1998

[30] Foreign Application Priority Data

Mar. 16, 1998 [TW] Taiwan ..... 87203804

[51] Int. Cl.[6] ..... H05B 1/02

[52] U.S. Cl. ..... 219/518; 219/502; 219/508; 219/250; 219/257

[58] Field of Search ..... 219/502, 497, 219/246–252, 518, 508, 257; 307/117, 119

[56] References Cited

U.S. PATENT DOCUMENTS 4,859,869 8/1989 Heuwinkel et al. ..... 219/251

5,719,379 2/1998 Huang et al. ..... 219/502

*Primary Examiner*—Mark H. Paschall

*Attorney, Agent, or Firm*—Limbach & Limbach L.L.P.

[57] ABSTRACT

A power control device for a pressing iron includes a position sensor that has a casing, an optical coupler and a shielding plate. The optical coupler is mounted in a lower part of the casing, and has a photoemitter and a photoreceiver that faces the photoemitter and that forms a clearance therewith. The shielding plate is received in the casing, and has an upper plate portion pivoted to an upper part of the casing, and a lower plate portion that extends into the clearance of the optical coupler. The lower plate portion is formed with a notch to permit light transmission between the photoemitter and the photoreceiver when the pressing iron is in an ironing position. The shielding plate pivots by virtue of gravity such that the notch is moved out of alignment with the photoemitter and the photoreceiver, and such that the lower plate portion blocks the light transmission between the photoemitter and the photoreceiver when the pressing iron is in a resting position.

6 Claims, 4 Drawing Sheets

POWER CONTROL DEVICE FOR A PRESSING IRON USING A POSITION SENSOR THAT INCLUDES AN OPTICAL COUPLER AND A SHIELDING PLATE

BACKGROUND OF THE INVENTION

1. Field of the Invention

The invention relates to a pressing iron, more particularly to a power control device for a pressing iron.

2. Description of the Related Art

It is known to provide a pressing iron with a power control device that incorporates a position sensor to permit disabling of a heating device of the iron upon detecting that the iron has been left unattended for a first time period, such as 30 seconds, in an ironing position, i.e. with its soleplate substantially horizontal, or for a second time period, such as from 5 to 8 minutes, in a resting position, i.e. with the soleplate substantially vertical.

The position sensor of a conventional power control device for a pressing iron is usually mounted in the handle portion of a housing of the pressing iron, and is used to detect if the iron is in the ironing or resting position. The position sensor includes a rectangular casing, an inclined ramp mounted on a bottom wall of the casing and inclining upwardly from a front portion to a rear portion of the casing, an optical coupler including a photoemitter and a photoreceiver mounted on left and right sides of the ramp at the rear portion of the casing, and an opaque ball received in the casing and movable along the ramp between a non-shielding position, where the ball is in the front portion of the casing and does not interrupt light transmission between the photoemitter and the photoreceiver when the iron is in the ironing position, and a shielding position, where the ball drops into the rear portion of the casing by virtue of gravity and interrupts light transmission between the photoemitter and the photoreceiver when the iron is in the resting position.

While the aforementioned position sensor is capable of generating signals to enable the power control device to detect whether the iron is in the ironing or resting position, the position sensor is not satisfactory due to the following reasons:

1. There is a possibility that the ball will get stuck between the top wall of the casing and the ramp, thereby resulting in faulty operation of the position sensor.

2. The ball must have a size that is sufficient to effectively block the light transmission between the photoemitter and the photoreceiver when the iron is in the resting position, thereby resulting in a corresponding increase in the size of the casing and in the size of the handle portion of the housing of the iron.

SUMMARY OF THE INVENTION

Therefore, the object of the present invention is to provide a power control device for a pressing iron, the power control device having a position sensor that includes an optical coupler and a shielding plate to result in a reliable and compact structure.

Accordingly, the power control device of this invention is to be used with a pressing iron that includes a soleplate with front and rear ends, a housing mounted on the soleplate, a heating device provided in the housing and operable so as to heat the soleplate, and a power supplying unit for supplying electric power to the heating device. The pressing iron is movable between a resting position, where the soleplate is substantially vertical, and an ironing position, where the soleplate is substantially horizontal. The power control device comprises a switch circuit, a position sensor and a processing unit. The switch circuit is adapted to connect electrically the heating device and the power supplying unit. The position sensor includes a casing, an optical coupler and a shielding plate. The casing has upper and lower parts with front and rear walls and left and right walls. The casing is adapted to be mounted in the housing such that each of the front and rear walls is disposed closer to a respective one of the front and rear ends of the soleplate than the other one of the front and rear walls. The optical coupler is mounted in the lower part of the casing, and has a photoemitter adjacent to one of the left and right walls and a photoreceiver adjacent to the other one of the left and right walls. The photoreceiver faces the photoemitter and forms a clearance therewith. The shielding plate is received in the casing, and has an upper plate portion pivoted to the upper part of the casing about a pivot axis that extends between the left and right walls, and a lower plate portion that extends into the clearance of the optical coupler. The lower plate portion is formed with a notch to permit light transmission between the photoemitter and the photoreceiver when the pressing iron is in the ironing position. The shielding plate pivots about the pivot axis by virtue of gravity such that the notch is moved out of alignment with the photoemitter and the photoreceiver, and such that the lower plate portion blocks the light transmission between the photoemitter and the photoreceiver when the pressing iron is in the resting position. The processing unit is connected electrically to the switch circuit and the optical coupler, and deactivates the switch circuit so as to disconnect the heating device from the power supplying unit upon detection that the shielding plate has continuously permitted the light transmission between the photoemitter and the photoreceiver for a first time period. The processing unit further deactivates the switch circuit upon detection that the shielding plate has continuously blocked the light transmission between the photoemitter and the photoreceiver for a second time period.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
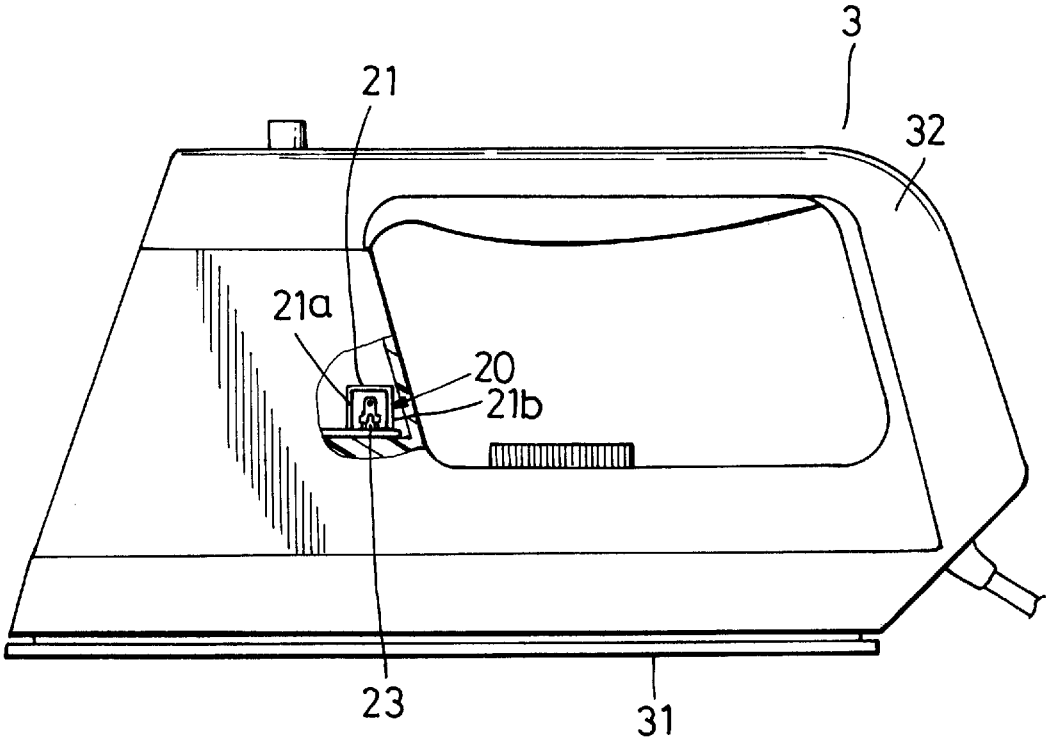
FIG. 1 is a schematic view illustrating a pressing iron that incorporates the preferred embodiment of a power control device according to the present invention.
Figure 5:
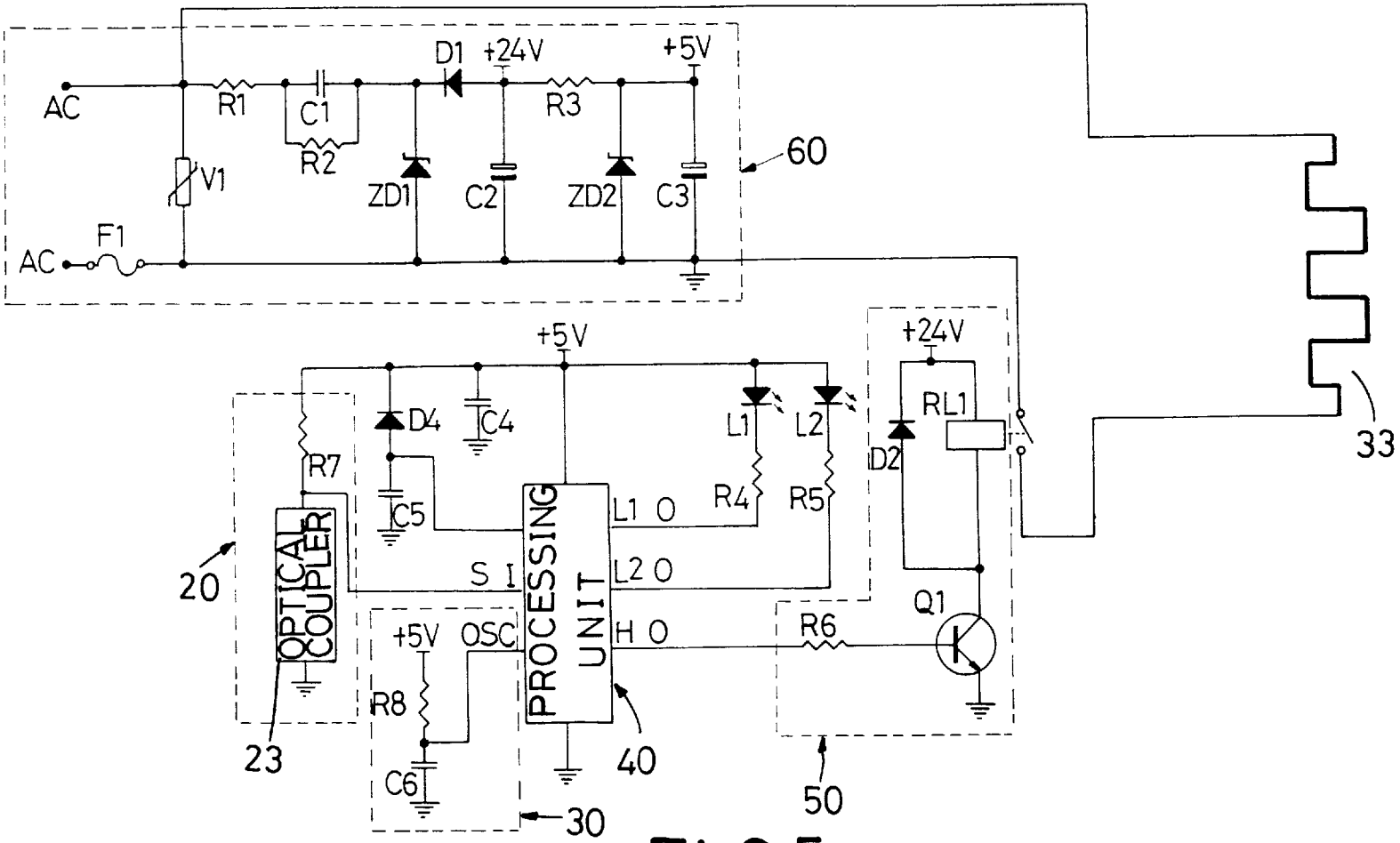
FIG. 5 is a schematic electrical circuit diagram of the preferred embodiment.

FIG. 1 illustrates a pressing iron 3 that incorporates the preferred embodiment of a power control device according to the present invention. The pressing iron 3 includes a soleplate 31, a housing 32 mounted on the soleplate 31, a heating device 33 (see FIG. 5) provided in the housing 32 and operable so as to heat the soleplate 31 in a conventional manner, and a power supplying unit 60 (see FIG. 5) for supplying electric power to the heating device 33. The pressing iron 3 is movable between a resting position (not shown), where the soleplate 31 is substantially vertical, and an ironing position (see FIG. 1), where the soleplate 31 is substantially horizontal. The power control device is mounted in the housing 32, and disconnects the heating device 33 from the power supplying unit 60 upon detection that the pressing iron 3 has been left unattended in the ironing position for a first time period, such as 30 seconds, or in the resting position for a second time period, such as from 5 to 8 minutes. As shown in FIG. 5, the power control device includes a position sensor 20, an oscillator 30, a processing unit 40, and a switch circuit 50 for connecting electrically the power supplying unit 60 to the heating device 33. The processing unit 40 is connected electrically to the position sensor 20, the oscillator 30 and the switch circuit 50.

Figure 2:
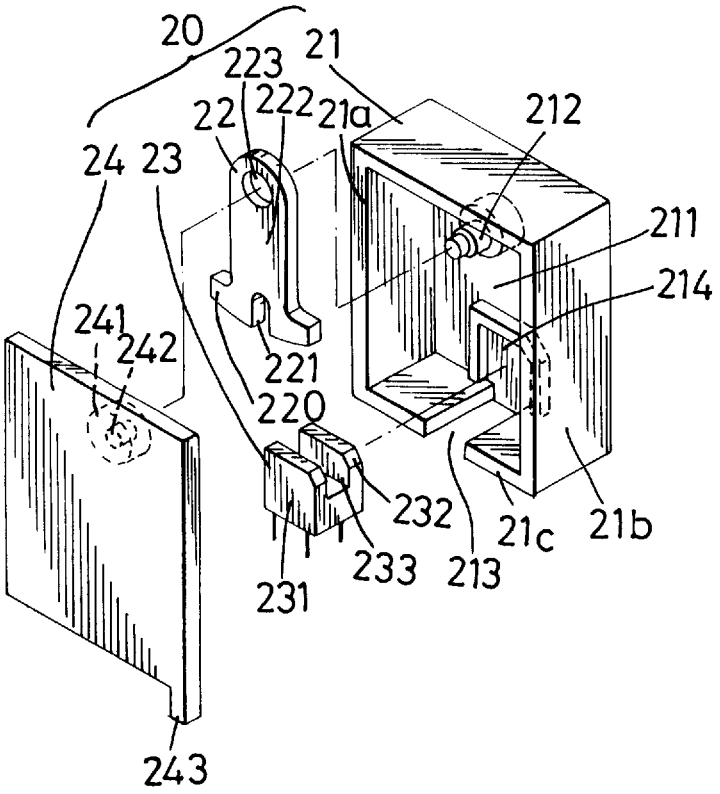
FIG. 2 is an exploded perspective view illustrating a position sensor of the preferred embodiment.

Referring to FIGS. 1 and 2, the position sensor 20 includes a casing 21, an optical coupler 23 and a shielding plate 22.

In this embodiment, the casing 21 is rectangular in shape, and has upper and lower parts with front and rear walls 21*a*, 21*b* and left and right walls 24, 211. The casing 21 is adapted to be mounted in the housing 32 such that each of the front and rear walls 21*a*, 21*b* is disposed closer to a respective one of the front and rear ends of the soleplate 31 than the other one of the front and rear walls 21*a*, 21*b*. The right wall 211 is formed with a pivot shaft 212 that extends toward the left wall 24 at the upper part of the casing 21, and a retaining seat 214 at the lower part of the casing 21. The casing 21 further has a bottom wall 21*c* to be secured to the housing 32 and formed with a slot 213 for access into the retaining seat 214. The left wall 24 is formed with a socket 241 that is formed with a socket hole 242 to engage one end of the pivot shaft 212. One corner of the left wall 24 is formed with a downward projection 243 that serves as a polarity indicator to ensure that the casing 21 can be mounted in a correct orientation within the housing 32.

The optical coupler 23 is mounted in the lower part of the casing 21. In this embodiment, the optical coupler 23 is fitted within the retaining seat 214, and has a photoemitter 231 adjacent to the left wall 24, and a photoreceiver 232 adjacent to the right wall 211. The photoreceiver 232 faces the photoemitter 231 and forms a clearance 233 therewith.

The shielding plate 22 is received in the casing 21, and has an upper plate portion 222 formed with a pivot hole 223, and a lower plate portion 220 wider than the upper plate portion 222. The size of the pivot hole 223 is slightly larger than the diameter of the pivot shaft 212 so that, when the pivot shaft 212 is extended through the pivot hole 223, the shielding plate 22 is freely pivotable about a pivot axis that extends between the left and right walls 24, 211 of the casing 21. The lower plate portion 220 extends into the clearance 233 of the optical coupler 23, and is formed with a notch 221.

Figure 3:
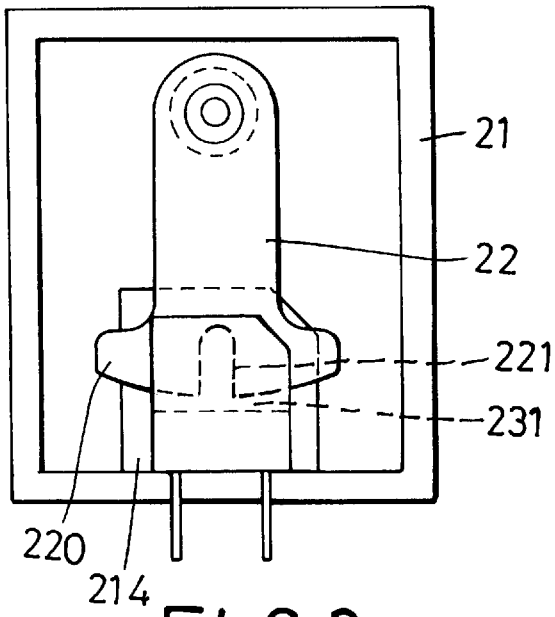
FIG. 3 is a schematic view of the position sensor of FIG. 2 when a shielding plate thereof is in a non-shielding state.

The design of the shielding plate 22 lowers its center of gravity so that, when the pressing iron 3 is in the ironing position, the notch 221 in the lower plate portion 220 of the shielding plate 22 can be aligned with the photoemitter 231 and the photoreceiver 232 to permit light transmission therebetween, as shown in FIG. 3. By monitoring the signals from the photoreceiver 232, the processing unit 40 detects if the pressing iron 3 has been left unattended in the ironing position for the first time period, and deactivates a relay RL1 of the switch circuit 50 to disconnect the heating device 33 from the power supplying unit 60 when the first time period is reached (see FIG. 5).

Figure 4:
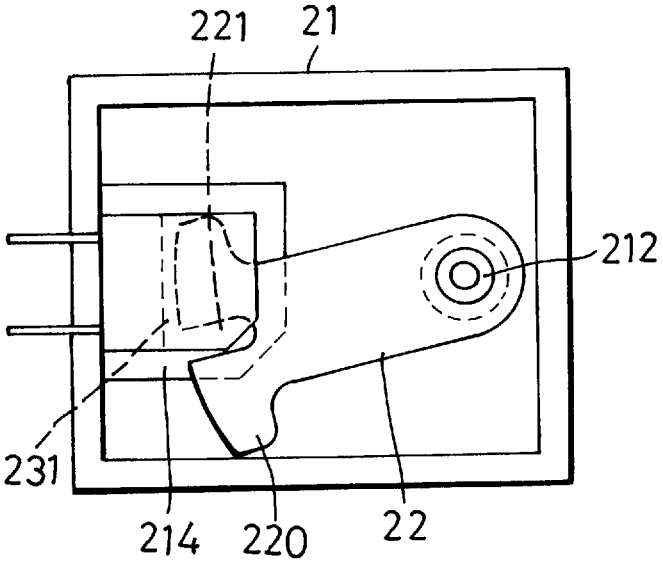
FIG. 4 is a schematic view of the position sensor of FIG. 2 when the shielding plate is in a shielding state.

When the pressing iron 3 is in the resting position, the shielding plate 22 pivots about the pivot shaft 212 by virtue of gravity such that the notch 221 is moved out of alignment with the photoemitter 231 and the photoreceiver 232 and such that the lower plate portion 220 blocks the light transmission between the photoemitter 231 and the photoreceiver 232, as shown in FIG. 4. Again, by monitoring the signals from the photoreceiver 232, the processing unit 40 detects if the pressing iron 3 has been left unattended in the resting position for the second time period, and deactivates the relay RL1 of the switch circuit 50 to disconnect the heating device 33 from the power supplying unit 60 when the second time period is reached (see FIG. 5).

The advantages of the power control device with the position sensor of this invention are as follows:

1. Unlike the conventional position sensor, which employs a ball that moves along an inclined ramp, the position sensor of this invention incorporates a shielding plate that is pivoted to a casing. The construction of the position sensor minimizes the possibility of faulty operation while ensuring increased sensitivity.

2. The position sensor uses simple and inexpensive components, and has a compact size as compared to the conventional position sensor described beforehand, thereby facilitating its installation in the housing of a pressing iron.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A power control device for a pressing iron, the pressing iron including a soleplate with front and rear ends, a housing mounted on the soleplate, a heating device provided in the housing and operable so as to heat the soleplate, and a power supplying unit for supplying electric power to the heating device, the pressing iron being movable between a resting position, where the soleplate is substantially vertical, and an ironing position, where the soleplate is substantially horizontal, said power control device comprising:

a switch circuit adapted to connect electrically the heating device and the power supplying unit;

a position sensor including a casing having upper and lower parts with front and rear walls and left and right walls, said casing being adapted to be mounted in the housing such that each of said front and rear walls is disposed closer to a respective one of the front and rear ends of the soleplate than the other one of said front and rear walls, an optical coupler mounted in said lower part of said casing and having a photoemitter adjacent to one of said left and right walls and a photoreceiver adjacent to the other one of said left and right walls, said photoreceiver facing said photoemitter and forming a clearance therewith, and a shielding plate received in said casing and having an upper plate portion pivoted to said upper part of said casing about a pivot axis that extends between said left and right walls, and a lower plate portion that extends into said clearance of said optical coupler, said lower plate portion being formed with a notch to permit light transmission between said photoemitter and said photoreceiver when the pressing iron is in the ironing position, said shielding plate pivoting about said pivot axis by virtue of gravity such that said notch is moved out of alignment with said photoemitter and said photoreceiver and such that said lower plate portion blocks the light transmission between said photoemitter and said photoreceiver when the pressing iron is in the resting position; and a processing unit connected electrically to said switch circuit and said optical coupler, said processing unit deactivating said switch circuit so as to disconnect the heating device from the power supplying unit upon detection that said shielding plate has continuously permitted the light transmission between said photoemitter and said photoreceiver for a first time period, said processing unit further deactivating said switch circuit upon detection that said shielding plate has continuously blocked the light transmission between said photoemitter and said photoreceiver for a second time period.

2. The power control device for a pressing iron as claimed in claim 1, wherein said lower plate portion of said shielding plate is wider than said upper plate portion.

3. The power control device for a pressing iron as claimed in claim 1, wherein said casing of said position sensor is formed with a downward projection that serves as a polarity indicator.

4. A pressing iron comprising a soleplate with front and rear ends, a housing mounted on said soleplate, a heating device provided in said housing and operable so as to heat said soleplate, a power supplying unit for supplying electric power to said heating device, and a power control device, said pressing iron being movable between a resting position, where said soleplate is substantially vertical, and an ironing position, where said soleplate is substantially horizontal, wherein said power control device includes:

a switch circuit connected electrically to said heating device and said power supplying unit;

a position sensor including a casing having upper and lower parts with front and rear walls and left and right walls, said casing being mounted in said housing such that each of said front and rear walls is disposed closer to a respective one of said front and rear ends of said soleplate than the other one of said front and rear walls, an optical coupler mounted in said lower part of said casing and having a photoemitter adjacent to one of said left and right walls and a photoreceiver adjacent to the other one of said left and right walls, said photoreceiver facing said photoemitter and forming a clearance therewith, and a shielding plate received in said casing and having an upper plate portion pivoted to said upper part of said casing about a pivot axis that extends between said left and right walls, and a lower plate portion that extends into said clearance of said optical coupler, said lower plate portion being formed with a notch to permit light transmission between said photoemitter and said photoreceiver when said pressing iron is in the ironing position, said shielding plate pivoting about said pivot axis by virtue of gravity such that said notch is moved out of alignment with said photoemitter and said photoreceiver and such that said lower plate portion blocks the light transmission between said photoemitter and said photoreceiver when said pressing iron is in the resting position; and a processing unit connected electrically to said switch circuit and said optical coupler, said processing unit deactivating said switch circuit so as to disconnect said heating device from said power supplying unit upon detection that said shielding plate has continuously permitted the light transmission between said photoemitter and said photoreceiver for a first time period, said processing unit further deactivating said switch circuit upon detection that said shielding plate has continuously blocked the light transmission between said photoemitter and said photoreceiver for a second time period.

5. The pressing iron as claimed in claim 4, wherein said lower plate portion of said shielding plate is wider than said upper plate portion.

6. The pressing iron as claimed in claim 4, wherein said casing of said position sensor is formed with a downward projection that serves as a polarity indicator.

* * * * *